US006921864B2

(12) United States Patent
Grogl et al.

(10) Patent No.: US 6,921,864 B2
(45) Date of Patent: Jul. 26, 2005

(54) CABLE WITH AT LEAST ONE TRANSMISSION ELEMENT

(75) Inventors: Ferdinand Grogl, Nuremberg (DE); Alfred Mehl, Georgensgmund (DE)

(73) Assignee: Nexans, Paris (FR)

( * ) Notice: Subject to any disclaimer, the term of this patent is extended or adjusted under 35 U.S.C. 154(b) by 488 days.

(21) Appl. No.: 09/915,528

(22) Filed: Jul. 27, 2001

(65) Prior Publication Data

US 2002/0011346 A1 Jan. 31, 2002

(30) Foreign Application Priority Data

Jul. 29, 2000 (DE) ..... 100 37 010

(51) Int. Cl.[7] ..... H01B 7/00
(52) U.S. Cl. ..... 174/120 R
(58) Field of Search ..... 174/120 R, 120 SR

(56) References Cited

U.S. PATENT DOCUMENTS 3,852,518 A * 12/1974 Wargotz et al. ..... 174/110 PM
4,430,385 A * 2/1984 Dillow et al. ..... 174/110 SR
5,059,483 A * 10/1991 Lunk et al. ..... 174/110 F
5,426,264 A * 6/1995 Livingston et al. ..... 174/102 R
5,917,155 A * 6/1999 Hake et al. ..... 174/120 R
6,162,994 A * 12/2000 Durand et al. ..... 174/120 R
6,207,277 B1 * 3/2001 Shieh ..... 428/375
6,403,890 B1 * 6/2002 McGregor et al. ..... 174/120 R

FOREIGN PATENT DOCUMENTS

DE 3604311 A1 8/1987
WO WO 00/30126 5/2000

OTHER PUBLICATIONS

"C&M Corporation" 1992, pp. 10 and 11.*

* cited by examiner

*Primary Examiner*—Chau N. Nguyen
(74) *Attorney, Agent, or Firm*—Sughrue Mion, PLLC

(57) ABSTRACT

A cable with at least one transmission element (A), which is surrounded by a sheath (M) of insulation material. To simplify stripping of the insulation, the sheath (M) is composed of an inner layer (3) and an outer layer (4), which are firmly bonded together. The values for tensile strength and elongation at break of the inner layer (3) are designed to be clearly lower than those of the outer layer (4).

9 Claims, 1 Drawing Sheet

CABLE WITH AT LEAST ONE TRANSMISSION ELEMENT

This application is based on and claims the benefit of German Patent Application No. 10037010.1 filed Jul. 29, 2000, which is incorporated by reference herein.

BACKGROUND OF THE INVENTION

The invention relates to a cable with at least one transmission element, which is surrounded by a sheath of insulation material, as described in published German utility model DE 298 08 657 U1. The cables to which the invention refers are used, for instance, in industrial automation systems as flexible power supply cables, as combined cables with power and control wires, and as control lines. Another possible field of application is automobile technology. The "transmission element" can thus be a power core or a control or pilot core suitable for transmitting electrical or optical signals. Particularly important in these cables is the outer sheath, which must be able to withstand all possible mechanical, thermal and chemical stresses. Suitable materials are known, primarily thermoplastic elastomers (TPE), polyurethane (PU) or polyvinyl chloride (PVC). These cables should furthermore be easy to strip from their insulation for connecting purposes, e.g., to join connectors.

The known cable according to the aforementioned utility model DE 298 08 657 U1 meets these requirements. It comprises two side-by-side electrical cores provided with differently colored insulation and surrounded with a wrapping, which is called a separator. An internal polyvinyl chloride sheath produced by extrusion and having a dimensionally precise cylindrical outer surface is put over the separator. The internal sheath is surrounded by a braid of tinned copper wires. For mechanical protection an outer polyvinyl chloride sheath is provided. The sheath of the cable can be readily severed by means of a special tool with a knife, which in working position penetrates the sheath structure exactly up to the separator. Production of this cable is very costly, however.

SUMMARY OF THE INVENTION

An object of the invention is to design the initially described cable in such a way that construction is simple and the insulation can be readily stripped without risk of injury to the conductor.

According to the invention, this object is attained in that the sheath comprises an inner layer and an outer layer which are firmly bonded together and the values for tensile strength and elongation at break of the inner layer are designed to be clearly lower than those of the outer layer.

This cable can be produced simply and without requiring special dimensional accuracy. It can be produced with conventional machines in a single pass, including the two layers for the sheath. The cable has an externally effective sheath with the desired or specified properties. But due to its special inner layer this sheath may be readily removed from the conductor, e.g., for connection purposes, without risking injury to the conductor. For this purpose, only the outer layer of the sheath must be completely severed. Minor nicking of the inner layer is of no consequence and may even be advantageous. The sheath can then be torn off at the cut. The cable is thus particularly suitable for semiautomatic or fully automatic prefabrication.

BRIEF DESCRIPTION OF THE DRAWINGS

Exemplary embodiments of the invention are illustrated in the drawings, in which.

DETAILED DESCRIPTION OF THE INVENTION

The transmission element of the cable according to the invention—as previously mentioned—may be a power core, an electrical control core or an optical control core. For the sake of simplicity, only the term "core" is used below. It covers all three variants.

Figure 1:
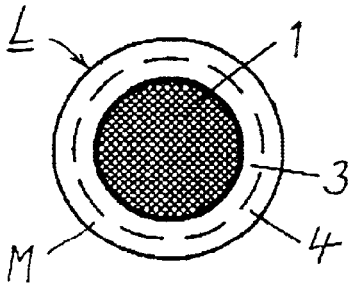
FIGS. 1 to 3 are cross sections through differently structured cables according to the invention.
Figure 2:
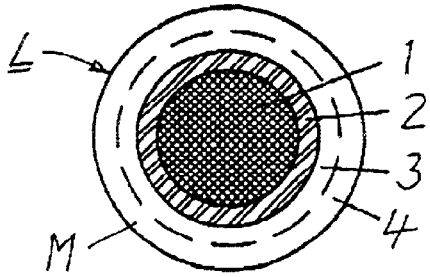

In the simplest embodiment, cable L according to FIG. 1 is made of one electrical conductor 1, which is surrounded by a sheath M of an insulating material. In this case, sheath M is thus also the insulation for conductor 1. In a preferred embodiment, such a cable L has a relatively large conductor cross section, for instance 25 $mm^2$. But the cable may also be a multi-core cable. This applies in principle also to a cable L in accordance with FIG. 2, in which conductor 1 is first provided with insulation 2, to which sheath M is then applied. The material used for insulation 2 is, for instance, polypropylene.

Sheath M is constructed of an inner layer 3 and an outer layer 4. The two layers 3 and 4 are firmly bonded together. They are preferably made of the same base material, e.g., a TPE, but have different properties due to additives that are added to the material of the inner layer 3. In a preferred embodiment, layers 3 and 4 may be applied to conductor 1 in the same pass, e.g., through tandem extrusion or coextrusion. This causes them to be directly and firmly bonded together. In the drawing, sheath M is not hatched. Its two-layer structure is indicated by a dashed line.

The inner layer 3 of sheath M compared to the outer layer 4 has both a significantly lower tensile strength and a significantly lower elongation at break. This may be achieved, for instance, by mixing additives into the corresponding base material, which in the extruded material have a strength-reducing and elongation-reducing effect. They may, for example, be polyolefins and chemically foamed additives. Furthermore, fillers or regenerators may be also used as additives, which in addition to the desired reduced strength and elongation values result in a reduced calorific value and thus impart a flame retardant effect to the extruded inner layer 3.

A necessary prerequisite is that the two layers 3 and 4, which are extruded separately but in the same production process, bond very well, i.e., inseparably and permanently. The bond must hold even during movements executed by cable L in operation.

The two layers 3 and 4 should have about the same thickness. In practice, the thickness ratio may be between about 60:40 and 40:60, where 60 applies to the outer layer 4. This ensures that both the mechanical and the chemical resistance of sheath M meet the requirements.

The tensile strength of inner layer 3, for instance, is only half of that of the outer layer 4. It is, for example, 20 $N/mm^2$. Its elongation at break, for instance, is smaller by a factor of three compared to outer layer 4. It is, e.g., about 150% compared to 500% of the outer layer 4.

Three examples of a material suitable for the inner layer 3 are given below:

Example 1

The base material is TPE polyether urethane, which is mixed with an equal amount of a polyolefin elastomer.

Example 2

The mixture comprises 40% polyether urethane (TPE) as the base material and 30% of a polyolefin elastomer and 30% calcium carbonate as additives.

Example 3

The mixture comprises 50% polyether urethane (TPE) as the base material and 20% of a polyolefin, 29% calcium carbonate and 1% of an expanding agent as additives.

Figure 3:
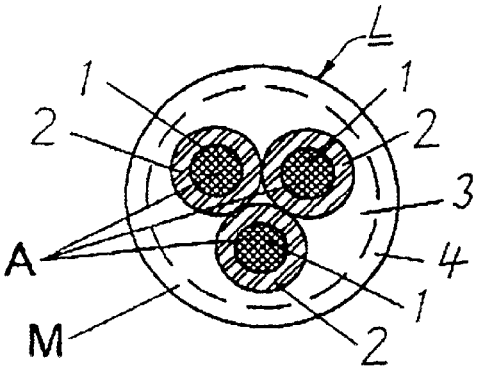

Cable L shown in cross section in FIG. 3 has three cores A that are stranded together. Core A comprises conductor 1 and insulation 2 surrounding it. Here, they are jointly surrounded by sheath M. Conductors 1 are preferably flexible, electrical stranded conductors made of copper wires. Cable L is shown with three cores A. It may instead have two cores, or more than three cores. Each core A may be constructed differently from the other cores. This is true, for instance, if both power cores and control cores are present in a cable L. The space intervals between the cores may be filled with a filler to produce an approximately circular circumferential area of the "core" of cable L, or with the material of sheath M surrounding cores A.

Figure 4:
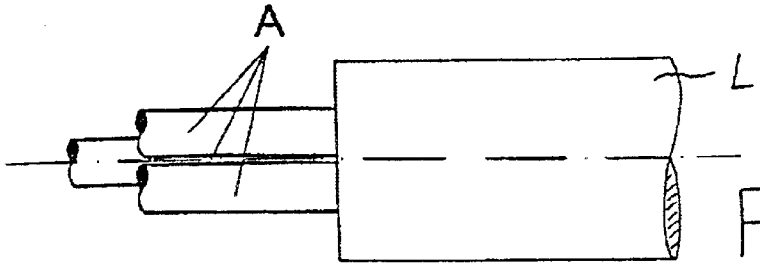
FIG. 4 is a side elevation of the cable according to FIG. 3 with the insulation removed at one end.

To strip the insulation from the end of cable L, only the outer layer 4 of the sheath M must be completely severed with a circular cut. Sheath M can then be pulled off in the longitudinal direction of cable L, so that the three cores A are freed from sheath M. This is shown in FIG. 4. Any nicking of the inner layer 3 that may occur as the outer layer 4 is being severed can be advantageous for the tear-off.

Figure 5:
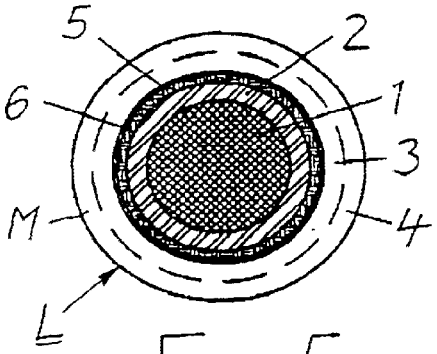
FIGS. 5 and 6 are cross sections of the cable in two additional embodiments.
Figure 6:
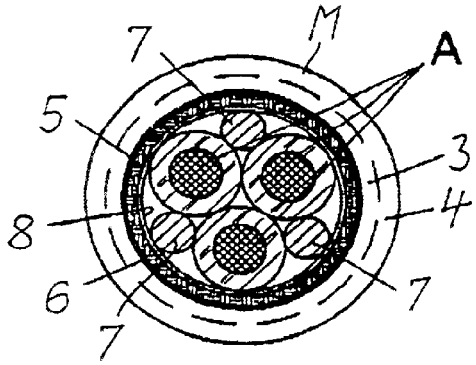

In the embodiments of cable L according to FIGS. 5 and 6, an electrical shield in the form of a braid or roping is disposed over the insulated conductor 1 or cores A. Prior to extruding sheath M, a separator 6 is advantageously placed around shield 5 to prevent penetration of the material of inner layer 3 of sheath M into shield 5. This is required for simple stripping of the insulation from cable L. Separator 6 is preferably made of a material that bonds with the inner layer 3 of sheath M.

In the embodiment of cable L according to FIG. 6, filler elements 7 are disposed in the space intervals between cores A. Prior to applying shield 5, a wrapping 8 is advantageously applied over cores A and filler elements 7 to serve as the base for shield 5. Wrapping 8 may be a nonwoven material, e.g., a nonwoven polyester.

What is claimed is:

1. A cable with at least one transmission element, which is surrounded by a sheath of insulation material, wherein the sheath (M) consists of only an inner layer (3) and an outer layer (4), which are made of materials being firmly bonded together when the outer layer (4) is extruded around the inner layer (3) and wherein the values for tensile strength and elongation at break of the inner layer (3) are significantly lower than those of the outer layer (4).

2. A cable as claimed in claim 1, wherein the two layers (3, 4) of the sheath (M) are of approximately the same thickness.

3. A cable as claimed in claim 1, wherein the thickness ratio of the outer layer (4) to the inner layer (3) is between 60:40 and 40:60.

4. A cable as claimed in claim 1, wherein the tensile strength of the inner layer (3) is approximately half of that of the outer layer (4).

5. A cable as claimed in claim 4, wherein the tensile strength of the inner layer (3) is about 20 $N/mm^2$.

6. A cable as claimed in claim 1, wherein the elongation at break of the inner layer (3) is no more than approximately one third of the elongation at break of the outer layer (4).

7. A cable as claimed in claim 6, wherein the elongation at break of the inner layer (3) is about 150%.

8. The cable according to claim 1, wherein both the inner layer and the outer layer are made of the same base material and the inner layer includes additives mixed into the base material that result in the lower values of the inner layer.

9. A cable with at least one transmission element, which is surrounded by a sheath of insulation material, wherein the sheath consists of only an inner layer and an outer layer, wherein the inner layer and the outer layer are firmly bonded together by extruding the outer layer around the inner layer without a separate adhesive therebetween, and wherein the values for tensile strength and elongation at break of the inner layer are significantly lower than those of the outer layer.

* * * * *